US010145594B2

(12) United States Patent
Fuller et al.

(10) Patent No.: US 10,145,594 B2
(45) Date of Patent: Dec. 4, 2018

(54) EXPANSION VALVE

(71) Applicant: DunAn Microstaq, Inc., Austin, TX (US)

(72) Inventors: E. Nelson Fuller, Manchester, MI (US); Parthiban Arunasalam, Austin, TX (US); Joe A. Ojeda, Austin, TX (US); Gengxun K. Gurley, Hutto, TX (US); Chen Yang, Austin, TX (US); Jennifer O'Keefe, Austin, TX (US)

(73) Assignee: DunAn Microstaq, Inc., Austin, TX (US)

( * ) Notice: Subject to any disclaimer, the term of this patent is extended or adjusted under 35 U.S.C. 154(b) by 57 days.

(21) Appl. No.: 15/399,792

(22) Filed: Jan. 6, 2017

(65) Prior Publication Data

US 2017/0219259 A1 Aug. 3, 2017

Related U.S. Application Data

(60) Provisional application No. 62/290,489, filed on Feb. 3, 2016.

(51) Int. Cl.
*F25B 41/06* (2006.01)

(52) U.S. Cl.
CPC ..... *F25B 41/062* (2013.01); *F25B 2341/06* (2013.01); *F25B 2600/2513* (2013.01)

(58) Field of Classification Search
CPC ..... F25B 41/062; F25B 2341/06; F25B 2600/2513
USPC ..... 137/625.64
See application file for complete search history.

(56) References Cited

U.S. PATENT DOCUMENTS 4,313,468 A * 2/1982 Patel ..... F15B 13/0438 137/625.64
4,527,592 A * 7/1985 Dotti ..... F15B 13/0433 137/625.64
4,576,200 A * 3/1986 Janecke ..... G05D 16/2093 137/625.64
5,836,335 A * 11/1998 Harms ..... F15B 13/0402 137/625.64
6,523,560 B1 2/2003 Williams et al.
6,540,203 B1 4/2003 Hunnicutt
6,543,481 B2 * 4/2003 Neff ..... F15B 13/0403 137/625.64
6,845,962 B1 1/2005 Barron et al.
7,156,365 B2 1/2007 Fuller et al.
8,001,993 B2 * 8/2011 Cook ..... F15B 13/0402 137/625.64
8,387,659 B2 3/2013 Hunnicutt
8,540,207 B2 * 9/2013 Hunnicutt ..... F15B 13/0402 251/30.01
9,140,613 B2 9/2015 Arunasalam et al.
9,188,375 B2 11/2015 Gurley et al.
9,551,435 B2 1/2017 Arunasalam et al.

* cited by examiner

*Primary Examiner* — Eric Keasel
(74) *Attorney, Agent, or Firm* — MacMillan, Sobanski & Todd, LLC

(57) ABSTRACT

A two-stage proportional control valve configured for use in a fluid system includes a valve body having a longitudinally extending valve body bore formed therethrough. A first stage microvalve is mounted within the valve body bore, and a second stage spool assembly is mounted within the valve body bore downstream of the microvalve. The second stage spool assembly includes a sleeve and a spool slidably mounted within the sleeve.

11 Claims, 11 Drawing Sheets

EXPANSION VALVE

BACKGROUND OF THE INVENTION

This invention relates in general to valves for controlling fluid flow. In particular, this invention relates to an improved structure for two-stage proportional control valve for use in a fluid system, such as a heating, ventilating, air conditioning, and refrigeration (HVAC-R) system.

One known two-stage proportional control valve is an expansion valve, such as a Modular Silicon Expansion Valve (MSEV). MSEVs are electronically controlled, normally closed, and single flow directional valves. MSEVs may be used for refrigerant mass flow control in conventional HVAC-R applications.

The first stage of the MSEV is a microvalve that acts as a pilot valve to control a second stage spool valve. When the microvalve receives a Pulse Width Modulation (PWM) signal, the microvalve modulates to change a pressure differential across the second stage spool valve. The spool valve will move to balance the pressure differential, effectively changing an orifice opening of the MSEV to control the flow of refrigerant.

There are however, undesirable manufacturing processes associated with known MSEVs. For example, the final machining steps necessary to ensure a required spool bore diameter in a valve body of the MSEV may only be accomplished after fluid inlet and fluid outlet connector tubes and capillary tubes have been brazed to the valve body. This sequence is required because bores machined into the valve body may become distorted by as much as about 30 μm by the heat used in the brazing operation. A typical machined spool bore in an MSEV valve body has a diameter tolerance of about +/−5 μm, and the brazing operation may cause the machined spool bore to become out of tolerance if the brazing operation is performed after the spool bore has been machined. Therefore, components such as the fluid inlet and fluid outlet connector tubes and the capillary tubes are commonly brazed to the valve body prior to the final machining steps. Because components such as the fluid inlet and fluid outlet connector tubes and the capillary tubes are brazed to the valve body prior to the final machining steps, fixtures and tools used to assemble the MSEV may be complex and costly, and manufacturing time may be undesirably lengthy.

MEMS (Micro Electro Mechanical Systems) are a class of systems that are physically small, having features with sizes in the micrometer range; i.e., about 10 μm or smaller. These systems have both electrical and mechanical components. The term "micromachining" is commonly understood to mean the production of three-dimensional structures and moving parts of MEMS devices. MEMS originally used modified integrated circuit (computer chip) fabrication techniques (such as chemical etching) and materials (such as silicon semiconductor material) to micromachine these very small mechanical devices. Today, there are many more micromachining techniques and materials available.

The term "micromachined device" as used in this application means a device having some features with sizes of about 10 μm or smaller, and thus by definition is at least partially formed by micromachining. More particularly, the term "microvalve" as used in this application means a valve having features with sizes of about 10 μm or smaller, and thus by definition is at least partially formed by micromachining. The term "microvalve device" as used in this application means a micromachined device that includes a microvalve, and that may include other components. It should be noted that if components other than a microvalve are included in the microvalve device, these other components may be micromachined components or standard sized (larger) components. Similarly, a micromachined device may include both micromachined components and standard sized (larger) components.

Various microvalve devices have been proposed for controlling fluid flow within a fluid circuit. A typical microvalve device includes a displaceable member or valve component movably supported by a body for movement between a closed position and a fully open position. When placed in the closed position, the valve component substantially blocks or closes a first fluid port that is otherwise in fluid communication with a second fluid port, thereby substantially preventing fluid from flowing between the fluid ports. Known microvalves thus allow some fluid to leak through a closed valve port, thus substantially preventing, but not completely preventing, fluid flow therethrough. When the valve component moves from the closed position to the fully open position, fluid is increasingly allowed to flow between the fluid ports.

U.S. Pat. Nos. 6,523,560; 6,540,203; and 6,845,962, the disclosures of which are incorporated herein by reference, describe microvalves made of multiple layers of material. The multiple layers are micromachined and bonded together to form a microvalve body and the various microvalve components contained therein, including an intermediate mechanical layer containing the movable parts of the microvalve. The movable parts are formed by removing material from an intermediate mechanical layer (by known micromachined device fabrication techniques, such as, but not limited to, Deep Reactive Ion Etching) to create a movable valve element that remains attached to the rest of the part by a spring-like member. Typically, the material is removed by creating a pattern of slots through the material to achieve the desired shape. The movable valve element will then be able to move in one or more directions an amount roughly equal to the slot width.

U.S. Pat. No. 7,156,365, the disclosure of which is also incorporated herein by reference, describes a method of controlling the actuator of a microvalve. In the disclosed method, a controller supplies an initial voltage to the actuator which is effective to actuate the microvalve. Then, the controller provides a pulsed voltage to the actuator which is effective to continue the actuation of the microvalve.

Because of the undesirable processes associated with manufacturing known two-stage proportional control valves, it would be desirable to provide an improved structure for a two-stage proportional control valve that is easier to manufacture, and in which the final machining steps necessary to manufacture the valve body may be accomplished before components such as the fluid inlet and fluid outlet connector tubes and the capillary tubes must been brazed thereto.

SUMMARY OF THE INVENTION

This invention relates to an improved structure for a two-stage proportional control valve for use in a fluid system, such as an HVAC-R system. In one embodiment, the two-stage proportional control valve configured for use in a fluid system includes a valve body having a longitudinally extending valve body bore formed therethrough. A first stage microvalve is mounted within the valve body bore, and a second stage spool assembly is mounted within the valve body bore downstream of the microvalve. The second stage spool assembly includes a sleeve and a spool slidably mounted within the sleeve.

In a second embodiment, a spool assembly configured for use in a two-stage proportional control valve in a fluid system includes a sleeve. The sleeve is substantially cylindrical and includes an axially extending sleeve bore formed therein and extending from an open first end to an open second end of the sleeve. A spool includes a spool bore extending axially from an open first end to a closed second end and slidably mounted within the sleeve bore.

In a third embodiment, a method of assembling a two-stage proportional control valve configured for use in a fluid system includes slidably mounting a spool within a sleeve to define a spool valve assembly. The spool valve assembly is mounted in a longitudinally extending valve body bore formed through a valve body of the two-stage proportional control valve. A first stage microvalve is also mounted within the valve body bore. The spool valve assembly defines a second stage spool assembly of the two-stage proportional control valve and is mounted within the valve body bore downstream of the microvalve.

Various aspects of this invention will become apparent to those skilled in the art from the following detailed description of the preferred embodiments, when read in light of the accompanying drawings.

DETAILED DESCRIPTION OF THE PREFERRED EMBODIMENTS

Figure 1:
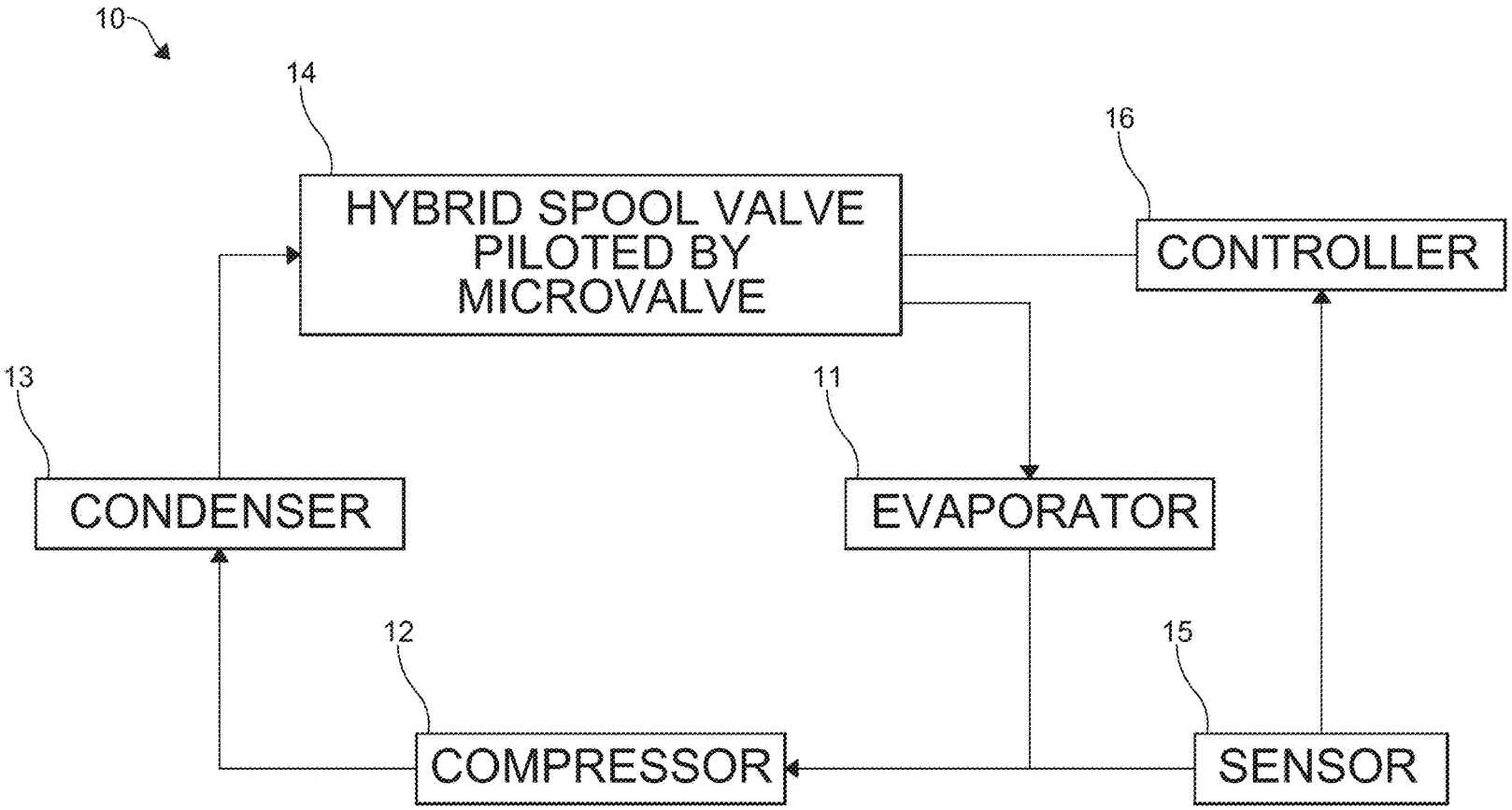
FIG. 1 is a block diagram of a representative embodiment of a refrigeration system including an HVAC-R expansion valve in accordance with this invention.

Referring now to the drawings, there is illustrated in FIG. 1 a block diagram of a representative embodiment of a refrigeration system, indicated generally at 10, in accordance with this invention. The illustrated refrigeration system 10 is, in large measure, conventional in the art and is intended merely to illustrate one environment in which this invention may be used. Thus, the scope of this invention is not intended to be limited for use with the specific structure for the refrigeration system 10 illustrated in FIG. 1 or with refrigeration systems in general. On the contrary, as will become apparent below, this invention may be used in any desired environment for the purposes described below.

As is well known in the art, the refrigeration system 10 circulates a refrigerant through a closed circuit, where it is sequentially subjected to compression, condensation, expansion, and evaporation. The circulating refrigerant removes heat from one area (thereby cooling that area) and expels the heat in another area.

To accomplish this, the illustrated refrigeration system 10 includes an evaporator 11, such as an evaporator coil. The evaporator 11 is conventional in the art and is adapted to receive a relatively low pressure liquid refrigerant at an inlet thereof. A relatively warm fluid, such as air, may be caused to flow over the evaporator 11, causing the relatively low pressure liquid refrigerant flowing in the evaporator 11 to expand, absorb heat from the fluid flowing over the evaporator 11, and evaporate within the evaporator 11. The relatively low pressure liquid refrigerant entering into the inlet of the evaporator 11 is thus changed to a relatively low pressure refrigerant gas exiting from an outlet of the evaporator 11.

The outlet of the evaporator 11 communicates with an inlet of a compressor 12. The compressor 12 is conventional in the art and is adapted to compress the relatively low pressure refrigerant gas exiting from the evaporator 12 and to move such relatively low pressure refrigerant gas through the refrigeration system 10 at a relatively high pressure. The relatively high pressure refrigerant gas is discharged from an outlet of the compressor 12 that communicates with an inlet of a condenser 13. The condenser 13 is conventional in the art and is configured to remove heat from the relatively high pressure refrigerant gas as it passes therethrough. As a result, the relatively high pressure refrigerant gas condenses and becomes a relatively high pressure refrigerant liquid.

The relatively high pressure refrigerant liquid then moves from an outlet of the condenser 13 to an inlet of an expansion device 14. In the illustrated embodiment, the expansion device 14 is a hybrid spool valve that is configured to restrict the flow of fluid therethrough. As a result, the relatively high pressure refrigerant liquid is changed to a relatively low pressure refrigerant liquid as it leaves the expansion device. The relatively low pressure refrigerant liquid is then returned to the inlet of the evaporator 11, and the refrigeration cycle is repeated.

The illustrated refrigeration system 10 additionally may include a conventional external sensor 15 that communicates with the fluid line that provides fluid communication from the evaporator 11 to the compressor 12. The external sensor 15 is responsive to one or more properties of the fluid (such as, for example, pressure, temperature, and the like) in such fluid line for generating a signal that is representative of that or those properties to a controller 16. In response to the signal from the external sensor 15 (and, if desired, other non-illustrated sensors or other inputs), the controller 16 generates a signal to control the operation of the expansion device 14. If desired, the external sensor 15 and the controller 16 may be embodied together as a conventional universal superheat sensor-controller, such as is commercially available from DunAn Microstaq, Inc. of Austin, Tex. U.S. Pat. No. 9,140,613 to Arunasalam et al. describes superheat sensors, controllers, and processors, and their operation. The disclosure of U.S. Pat. No. 9,140,613 is incorporated herein by reference.

Figure 3:
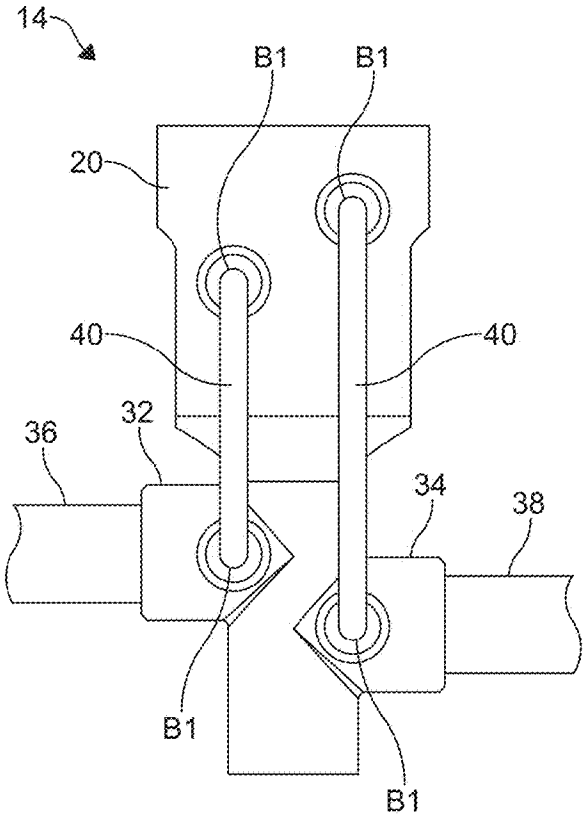
FIG. 3 (Prior Art)
FIG. 3 is front elevational view of the conventional HVAC-R expansion valve illustrated in FIG. 2.
Figure 2:
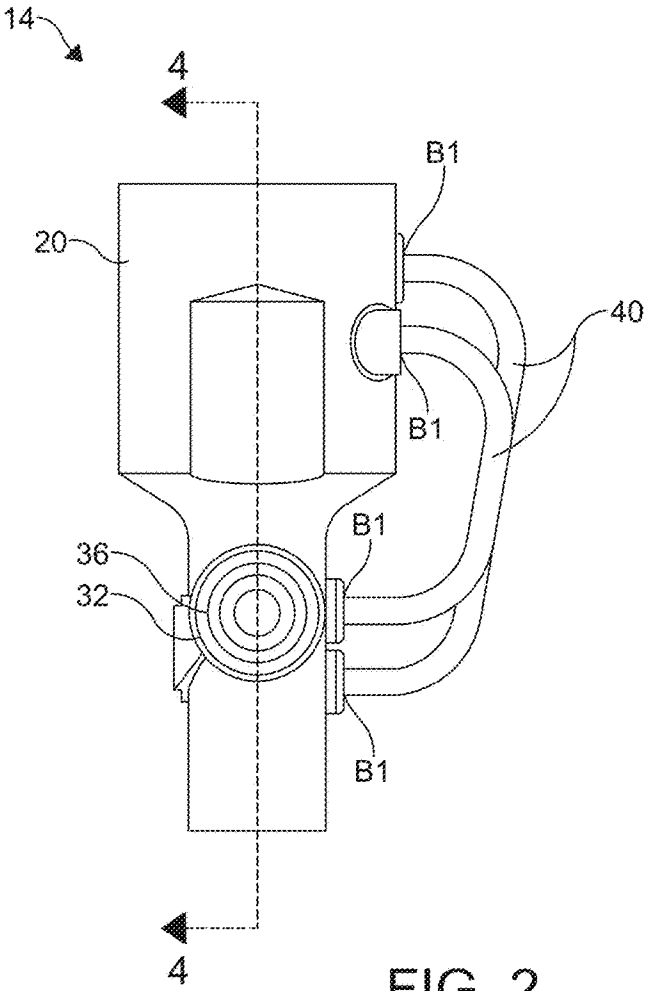
FIG. 2 (Prior Art)
FIG. 2 is a side elevational view of a conventional HVAC-R expansion valve.
Figure 4:
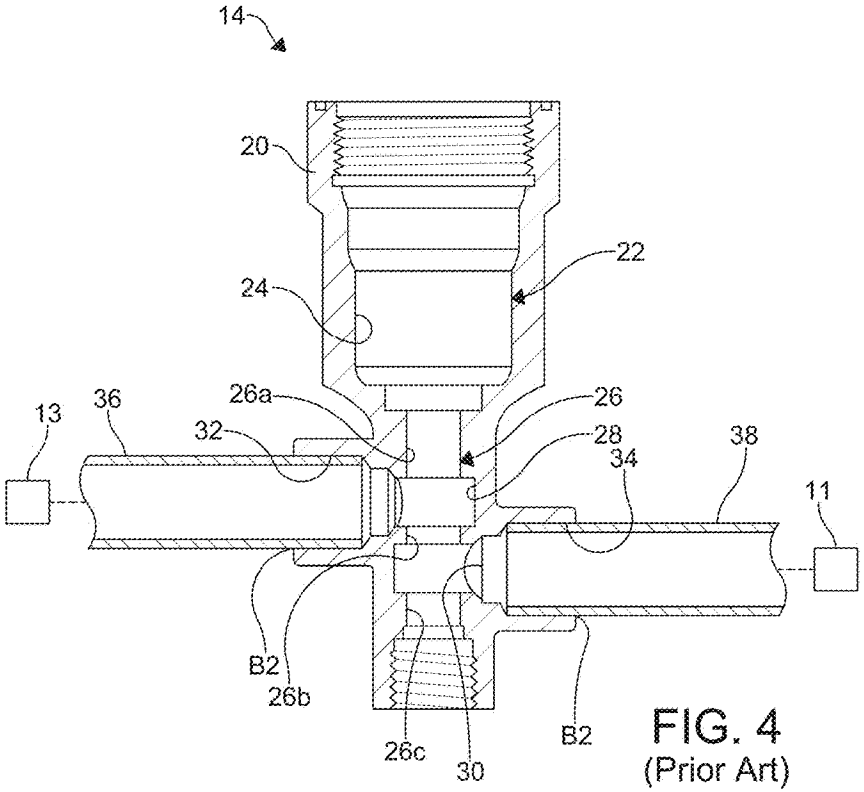
FIG. 4 (Prior Art)
FIG. 4 is a cross sectional view taken along the line 4-4 of FIG. 3 and shown with the plugs and spool removed.

FIGS. 2 through 4 illustrate a conventional hybrid spool valve. The illustrated conventional hybrid spool valve is a two-stage proportional control valve configured as a Modular Silicon Expansion Valve (MSEV) 14. In FIG. 4, the MSEV 14 is shown with a conventional first plug and attached conventional first stage microvalve, a conventional second plug, and a conventional second stage spool removed for clarity.

Referring now to FIGS. 5 through 13, an improved two-stage proportional control valve configured as an MSEV is shown at 50. The MSEV 50 includes a valve body 52 defining a longitudinally extending bore 54 formed therein and extending between a first end 52*a* and a second end 52*b* of the valve body 52. The bore 54 includes a first portion or plug bore 60 configured to receive a first plug defining a microvalve assembly 64 (see FIG. 7), and a second portion or spool assembly bore 62 configured to receive a spool assembly 66 (see FIG. 7). An axial end surface 53 of the first end 52*a* of the valve body 52 (the upwardly facing surface when viewing FIG. 7) includes an annular sealing groove 53*a* formed therein.

Figure 7:
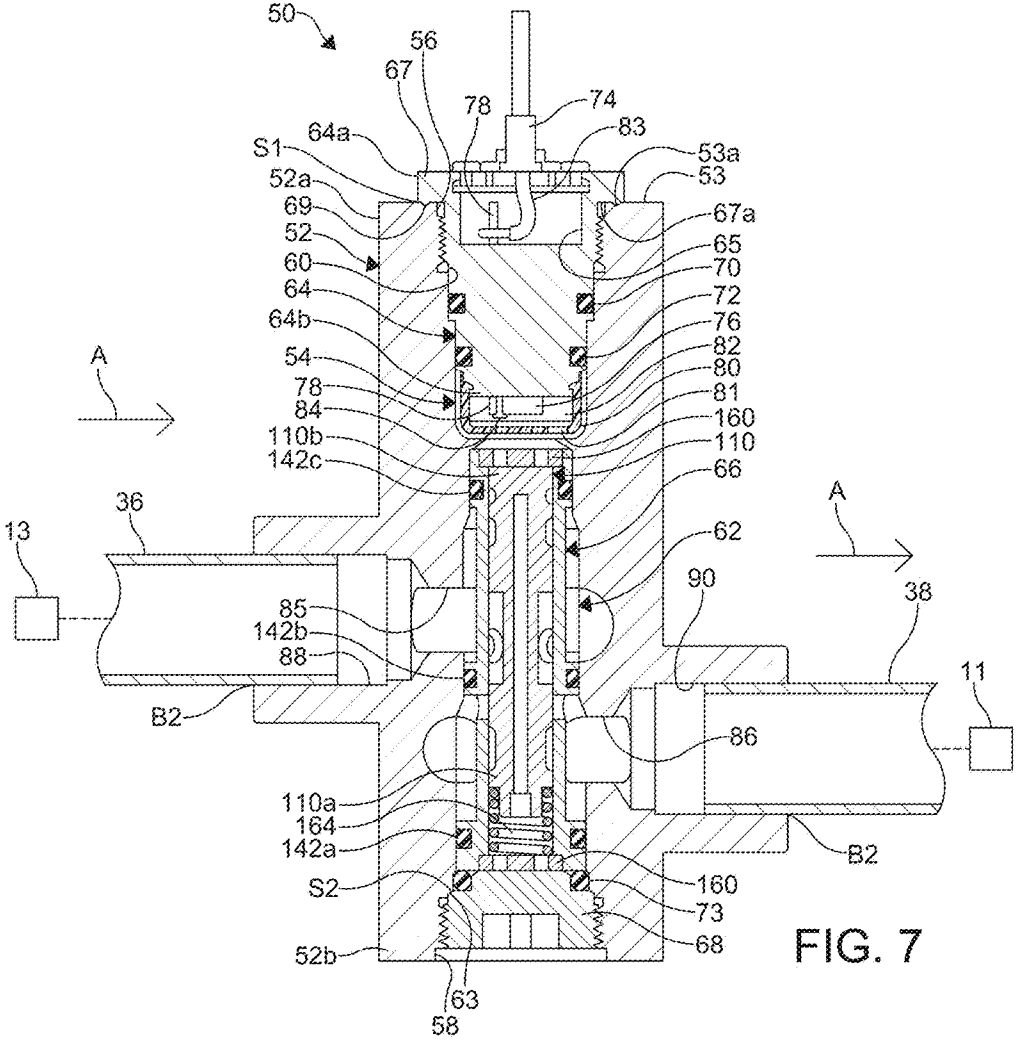
FIG. 7 is a cross sectional view taken along the line 7-7 of FIG. 5.

An opening 56 (see FIG. 8) of the bore 54 at the first end 52*a* of the valve body 52 may be closed by the microvalve assembly 64. Similarly, an opening 58 (see FIG. 8) of the bore 54 at the second end 52*b* of the valve body 52 may be closed by a closure member or second plug 68. The second plug 68 includes external threads and is configured for threaded attachment within the spool assembly bore 62. The plugs 64 and 68 may be sealingly fixed in the respective openings 56 and 58 by any suitable means, such as by welding, press fitting, rolling, or as illustrated, held in place by a threaded connection. As shown in FIG. 7, the microvalve assembly 64 includes a radially outwardly extending flange 67 at a first end thereof. A sealing surface 67*a* of the flange 67 (the downwardly facing surface when viewing FIG. 7) includes an annular sealing ridge 69 extending outwardly therefrom.

The microvalve assembly 64 may be made leak-tight by a metal to metal interference seal S1 defined between the annular sealing ridge 69 and the annular sealing groove 53*a*, and one or more annular seals, such as O-rings 70 and 72. Similarly, the second plug 68 may be made leak tight by a metal to metal interference seal S2 defined between an outside surface of the second plug 68 and a shoulder 63 formed in the spool assembly bore 62. The second plug 68 may be further made leak tight by an O-ring 73. It will be understood however, that the metal interference seal S2 may be sufficient to seal the second plug 68 within the spool assembly bore 62, and the O-ring 73 may not be required. An electrical connector 74 extends outwardly from an outside axial end of the microvalve assembly 64. A microvalve 76 may be mounted to an inboard axial end of the microvalve assembly 64 (the lower end of the microvalve assembly 64 when viewing FIG. 7) by any suitable method, such as with solder.

Electrical connectors, such as posts or pins 78, extend between a cavity 65 formed in the first end 64*a* of the microvalve assembly 64 and a second end 64*b* of the microvalve assembly 64. First electrical connectors, such as wires 83, electrically connect the pins 78 to a source of electrical power (not shown) via the electrical connector 74. Second electrical connectors, such as wires 84 electrically connect the microvalve 76 to the pins 78 at the second end 64*b* of the microvalve assembly 64.

A substantially cup-shaped cap 80 is attached to an outside surface of the microvalve assembly 64 at a second end 64*b* thereof. The cap 80 has a substantially cylindrical outer surface and includes an opening 81 in an end wall thereof that defines a flow path for fluid between the microvalve 76 and the spool assembly bore 62. An interior of the cap 80 defines a cavity 82 within which the microvalve 76 is mounted. The illustrated cap 80 is preferably formed from glass filled nylon. Alternatively, the cap 80 may be formed from any desired polymer or other material.

Figure 8:
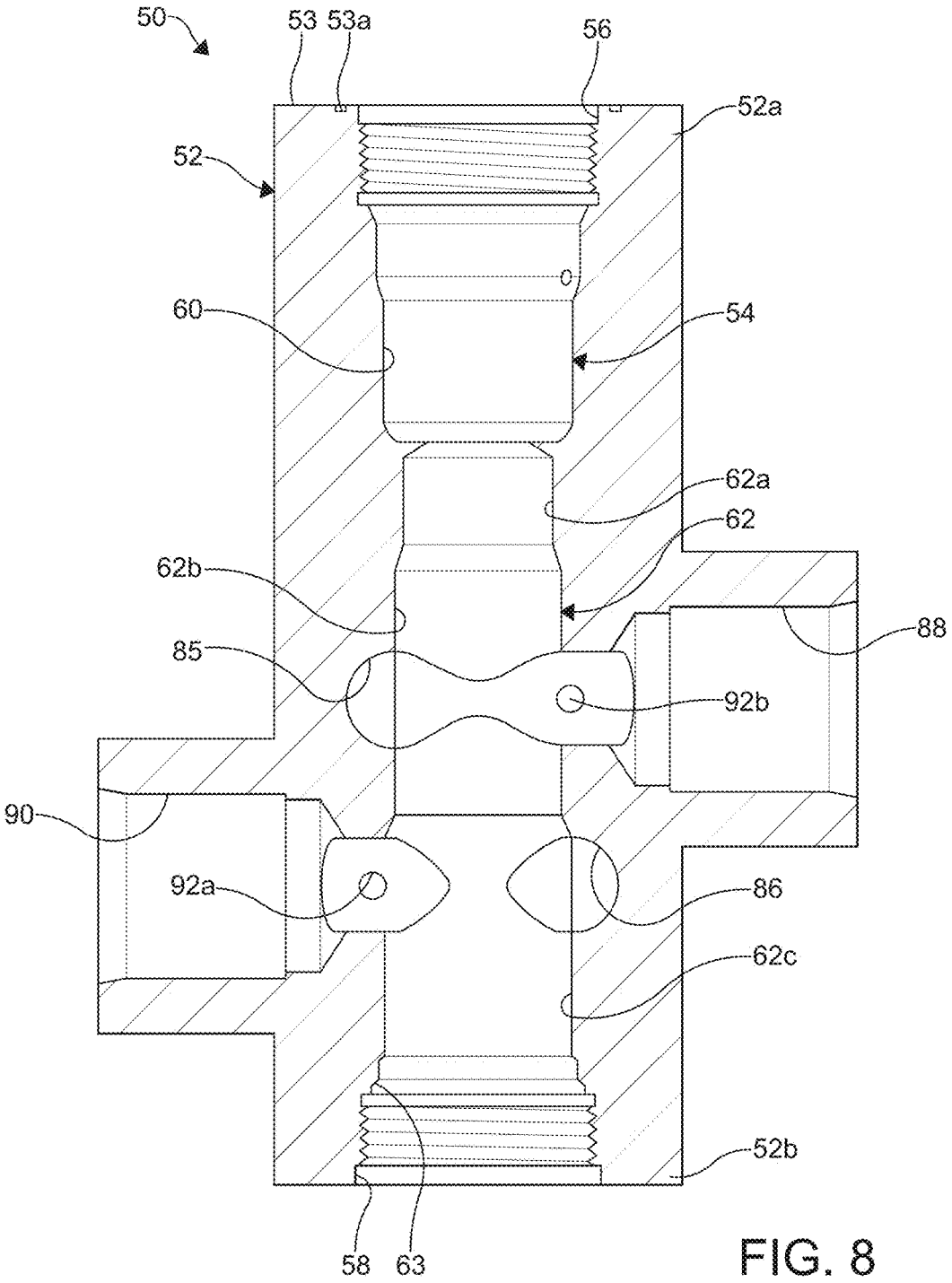
FIG. 8 is an enlarged cross sectional view of the valve body shown in FIG. 7.
Figure 9:
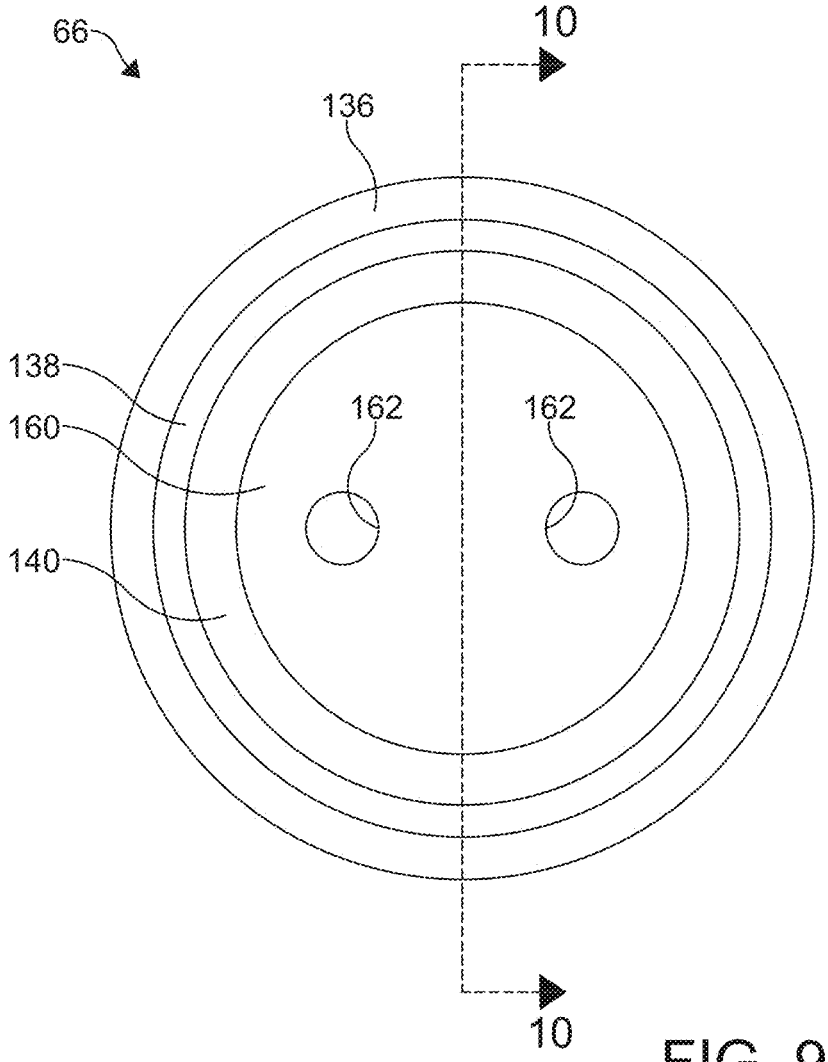
FIG. 9 is an end view of the improved spool assembly shown in FIG. 7.

Referring to FIG. 8, the spool assembly bore 62 includes a first diameter portion 62*a* adjacent the plug bore 60, a second diameter portion 62*b*, and a third diameter portion 62*c* at the second end 52*b* of the valve body 52. The second diameter portion 62*b* is larger than the first diameter portion 62*a*, and smaller than the third diameter portion 62*c*. A first circumferentially extending fluid flow groove 85 is formed in an inside surface of the second diameter portion 62*b* of the spool assembly bore 62, and a second circumferentially extending fluid flow groove 86 is formed in an inside surface of the third diameter portion 62*c* of the spool assembly bore 62.

The valve body 52 further includes a transversely extending fluid inlet port 88 and a transversely extending fluid outlet port 90 in fluid communication with the spool assembly bore 62 via the fluid flow grooves 85 and 86, respectively. As shown in FIG. 7, the fluid inlet port 88 is in fluid communication with the condenser 13 via the inlet connector conduit 36, and the fluid outlet port 90 is in fluid communication with the evaporator 11 via the outlet connector conduit 38. Thus, as shown in FIGS. 6 and 7, fluid may flow through the MSEV 50 in the direction of the arrows A.

Figure 5:
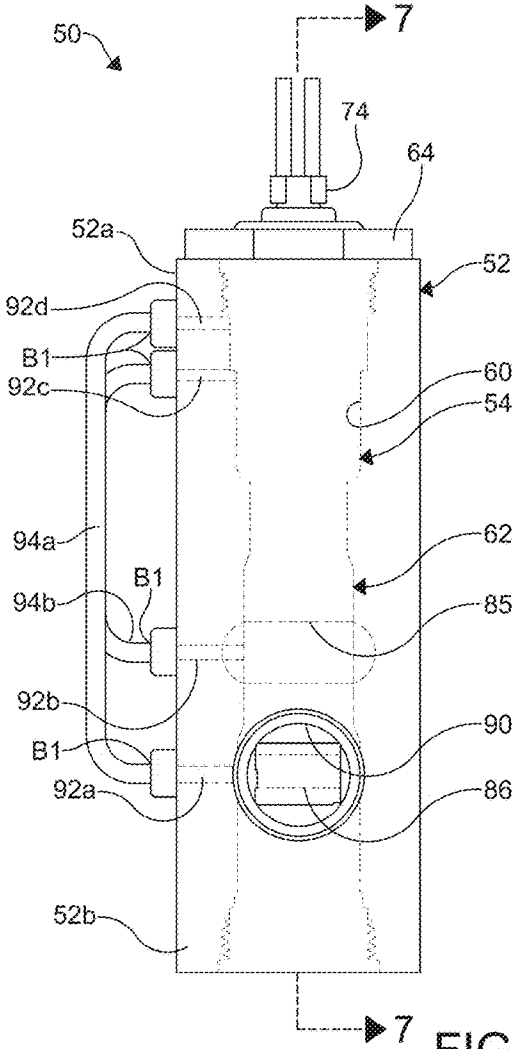
FIG. 5 is a side elevational view of an improved HVAC-R expansion valve according to this invention.

As shown in FIG. 5, transversely extending capillary bores 92*a* and 92*b* are formed in the valve body 52 and extend outwardly from the fluid flow grooves 86 and 85, respectively. Transversely extending capillary bores 92*c* and 92*d* are also formed in the valve body 52 and extend outwardly from the plug bore 60 of the bore 54 and are in fluid communication with fluid flow conduits (not shown) formed in the microvalve assembly 64. These fluid flow conduits (not shown) supply fluid to the microvalve 76.

Figure 6:
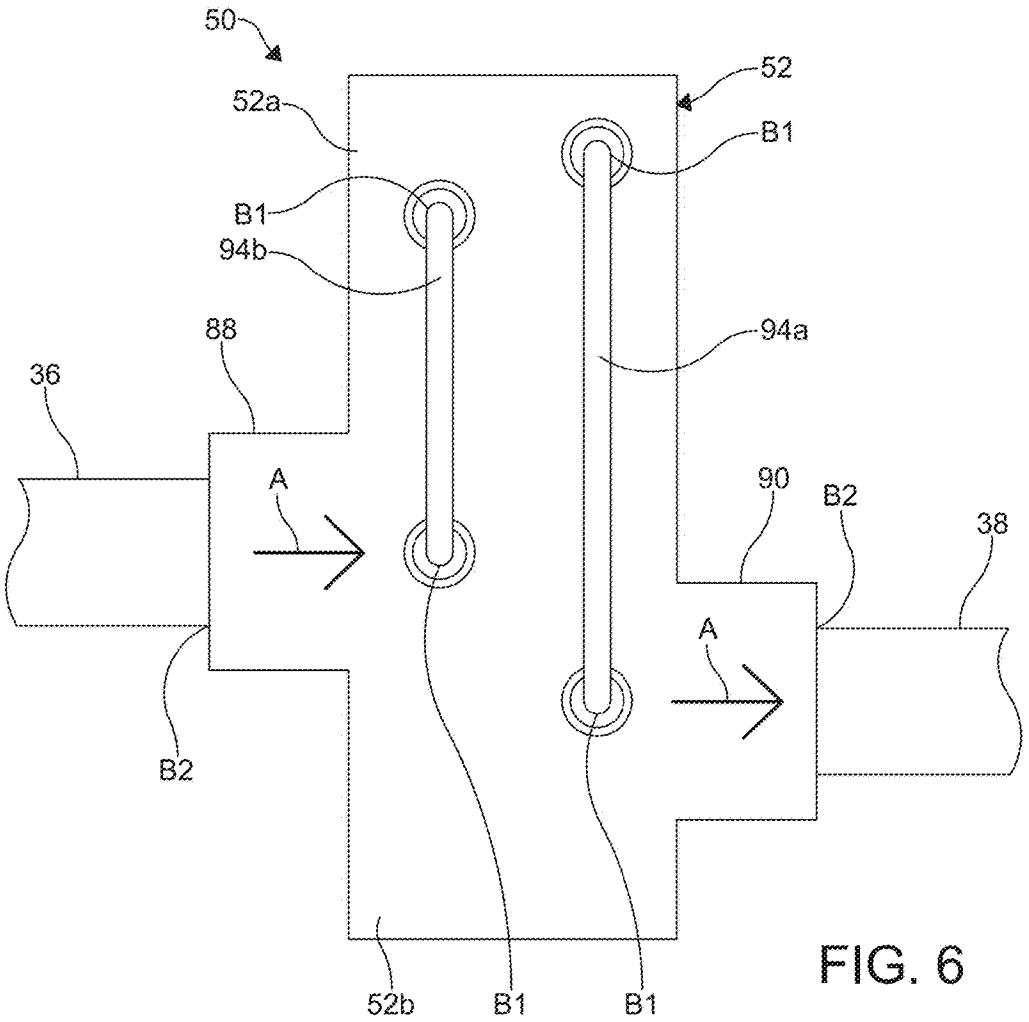
FIG. 6 is a front elevational view of the improved HVAC-R expansion valve illustrated in FIG. 5.

Referring to FIGS. 5 and 6, a first capillary tube 94*a* extends between the capillary bore 92*a* and the capillary bore 92*d*. A second capillary tube 94*b* extends between the capillary bore 92*b* and the capillary bore 92*c*. The joints between the capillary tubes 94*a* and 94*b* and the valve body 52 may be brazed joints and are shown at B1 in FIGS. 5 and 6. Similarly, the joints between the fluid inlet and fluid outlet ports 88 and 90 and the inlet and outlet connector conduits 36 and 38, respectively, may also be brazed joints and are shown at B2 in FIGS. 6 and 7.

The conventional MSEV 14 illustrated in FIGS. 2 through 4 includes a valve body 20 defining a longitudinally extending bore 22 having a first portion 24 configured to receive the microvalve assembly 64 (shown removed for clarity), and a second portion or spool bore 26 configured to receive the spool assembly 66 (shown removed for clarity). The spool bore 26 includes three sections 26*a*, 26*b*, and 26*c*, the inside diameters of each require a dimensional manufacturing tolerance of about +/−5 μm.

The spool bore 26 also includes a circumferentially extending first groove defining a fluid inlet chamber 28, and a circumferentially extending second groove defining a fluid outlet chamber 30.

The valve body 20 further includes a transversely extending inlet port 32 and a transversely extending outlet port 34. The inlet port 32 is in fluid communication with the condenser 13 via an inlet connector conduit 36. The outlet port 34 is in fluid communication with the evaporator 11 via an outlet connector conduit 38.

Capillary tubes 40 extend between the inlet and outlet ports 32 and 34 and fluid flow conduits (not shown) formed in the microvalve assembly 64. These fluid flow conduits supply fluid to the first stage microvalve (not shown). The joints between the capillary tubes 40 and the valve body 20 are typically brazed joints and are shown at B1 in FIGS. 2 and 3. Similarly, the joints between the inlet and outlet ports 32 and 34 and the inlet and outlet connector conduits 36 and 38 are also typically brazed joints and are shown at B2 in FIGS. 3 and 4.

When manufacturing the conventional MSEV 14, the valve body 20, the capillary tubes 40, and the inlet and outlet connector conduits 36 and 38 are first assembled and brazed as shown in FIGS. 2 through 4. After the brazing step in the manufacturing process, the final machining steps necessary to finish the spool bore 26 of the bore 22 may be completed. This sequence is required because the machined spool bore 26 in the valve body 20 may become distorted by as much as 30 μm by the heat used in the brazing operation. Such distortion is undesirable because spool bores, such as the spool bore 20, typically require a dimensional manufacturing tolerance of about +/−5 μm, and the brazing operation may cause the spool bore 20 to become out of tolerance if the brazing operation is performed after the spool bore 20 has been machined.

Referring to FIGS. 9 through 13, a first embodiment of an improved spool assembly 66 in accordance with this invention is shown. The spool assembly includes a substantially cylindrical spool 110 within a sleeve 112. The spool 110 includes an axially extending bore 114 formed therein and extending from an open first end 110*a* to a closed second end 110*b* of the spool 110. The first end 110*a* of the spool 110 includes a reduced diameter portion 116 defining a shoulder 118. A substantially cup-shaped insert 115 is attached within the bore 114 at the open first end 110*a* of the spool 110. A feedback pressure chamber 117 may be defined in an interior of the insert 115. The insert 115 has a substantially cylindrical outer surface and includes an opening 119 in an end wall thereof that defines a flow path for fluid between the feedback pressure chamber 117 and the spool bore 114.

A first circumferentially extending groove 120 is formed on an outside surface of the spool 110 intermediate the first and second ends 110*a* and 110*b*. The circumferentially extending groove 120 defines a fluid flow path. A second circumferentially extending groove 122 is formed on an outside surface of the spool 110 near the first end 110*a* thereof, and a third circumferentially extending groove 124 is formed on an outside surface of the spool 110 near the second end 110*b* thereof. A circumferentially extending pressure groove 126 is also formed on an outside surface of the spool 110 between the second axial end 110*b* and the third circumferentially extending groove 124.

A first transverse fluid passageway 128 is formed through a side wall of the spool 110 between the bore 114 and the second circumferentially extending groove 122, and a second transverse fluid passageway 130 is formed through a side wall of the spool 110 between the bore 114 and the third circumferentially extending groove 124. A third transverse fluid passageway 132 is formed through a side wall of the spool 110 between the bore 114 and the circumferentially extending pressure groove 126.

The sleeve 112 is substantially cylindrical and includes an axially extending spool bore 134 formed therein and extending from an open first end 112*a* to an open second end 112*b* of the sleeve 112.

A first circumferentially extending sealing portion 136 is formed on an outside surface of the sleeve 112 and defines a first circumferentially extending sealing groove 136*a*. A second circumferentially extending sealing portion 138 is also formed on an outside surface of the sleeve 112 and defines a second circumferentially extending sealing groove 138*a*. Additionally, a third circumferentially extending sealing portion 140 is formed on an outside surface of the sleeve 112 and defines a third circumferentially extending sealing groove 140*a*.

A first annular seal 142*a*, such as an O-ring, may be disposed within the first circumferentially extending sealing groove 136*a*. Similarly, second and third annular seals 142*b* and 142*c*, such as O-rings, may be disposed within the second and third circumferentially extending sealing groove 138*a* and 140*a*, respectively.

A circumferentially extending inlet fluid flow groove 144 is defined in the outside surface of the sleeve 112 between the second and third sealing portions 138 and 140. Similarly, a circumferentially extending outlet fluid flow groove 146 is defined in the outside surface of the sleeve 112 between the first and second sealing portions 136 and 138.

At least one main fluid flow inlet passageway 148 is formed through a side wall of the sleeve 112 between the bore 134 and the inlet fluid flow groove 144, and at least one main fluid flow outlet passageway 150 is formed through the side wall of the sleeve 112 between the bore 134 and the outlet fluid flow groove 146. Additionally, at least one feedback flow inlet passageway 152 is formed through the side wall of the sleeve 112 between the bore 134 and the inlet fluid flow groove 144, and at least one feedback flow outlet passageway 154 is formed through the side wall of the sleeve 112 between the bore 134 and the outlet fluid flow groove 146.

Figure 10:
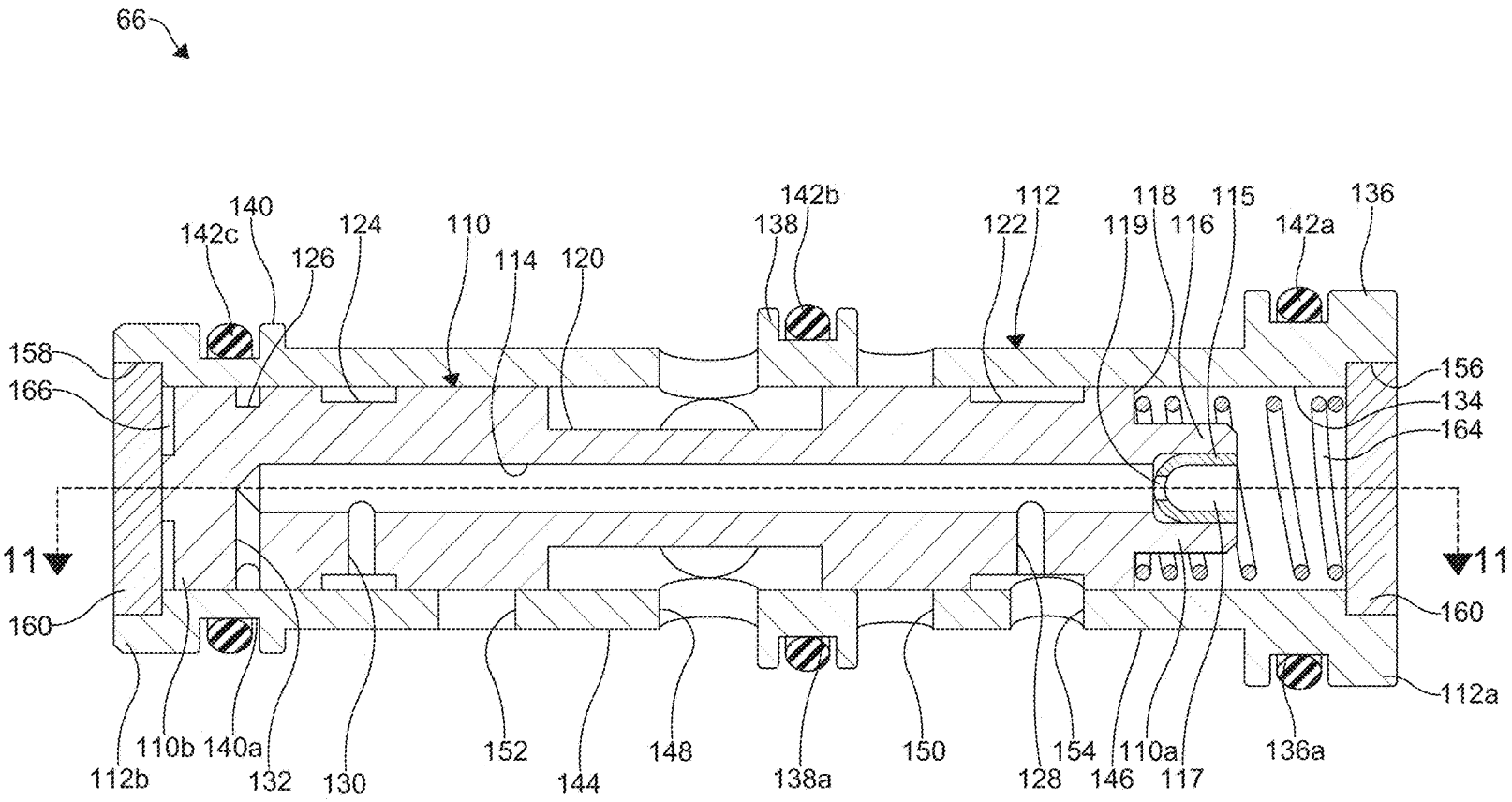
FIG. 10 is a cross sectional view of the improved spool assembly taken along the line 10-10 of FIG. 9.
Figure 11:
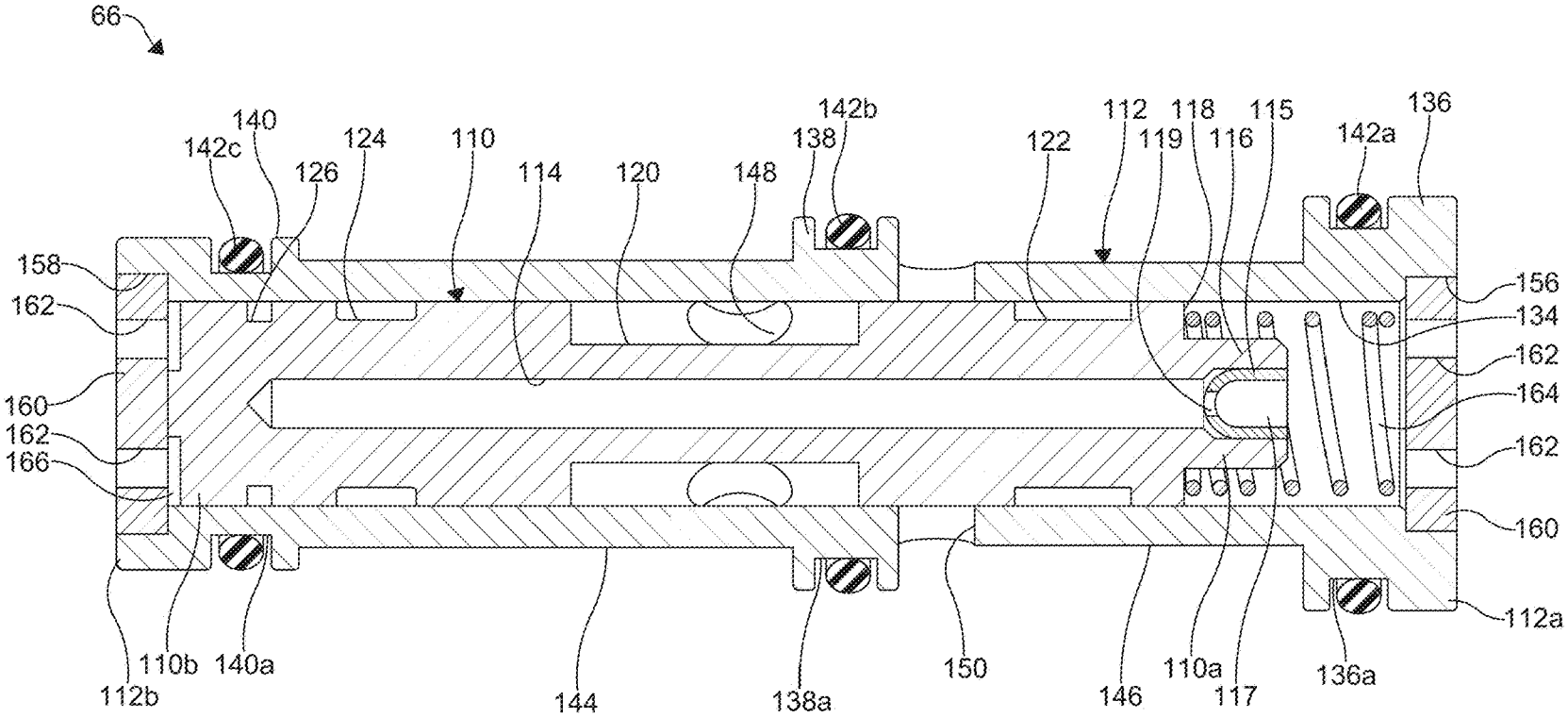
FIG. 11 is a cross sectional view of the improved spool assembly taken along the line 11-11 of FIG. 10.

A first cap cavity 156 is formed in the first end 112*a* of the sleeve 112 and a second cap cavity 158 is formed in the second end 112*b* of the sleeve 112. A closure member or cap 160 is mounted within each of the first and second cap cavities 156 and 158, and may be attached therein by any desired means, such as by threaded attachment, staking, or by welding. The cap 160 may include one or more fluid passageways 162 (see FIGS. 9 and 11) formed therethrough. A spring 164 extends between the cap 160 at the first end 112*a* of the sleeve 112 and the shoulder 118 of the spool 110. The spring 164 urges the second end 110*b* of the spool 110 toward the second end 112*b* of the sleeve 112 and thus urges the spool 110 into an un-actuated or closed position, as shown in FIGS. 10 and 11. In the closed position, the main fluid flow outlet passageway 150 is closed by the spool 110, thus preventing fluid flow through the spool assembly 66. In the closed position, the feedback flow inlet passageway 152 is also closed by the spool 110, but the feedback flow outlet passageway 154 is open and in fluid communication with the outlet fluid flow groove 146, the second circumferentially extending fluid flow groove 86 (see FIG. 8), and the fluid outlet port 90 (see FIG. 8). A command chamber 166 may be defined between an axial end face of the second end 110*b* of the spool 110 and the adjacent cap 160.

In operation, when it is desired to operate the spool assembly 66 and move fluid therethrough, the microvalve 76 may be actuated. The fluid discharged from the microvalve 76 controls a command pressure on the second end 110*b* of the spool 110. The command pressure acting on the second end 110*b* of the spool 110 urges the spool 110 against the force of the spring 164 (downward when viewing FIG. 7 and to the right when viewing FIGS. 10 and 11).

Figure 12:
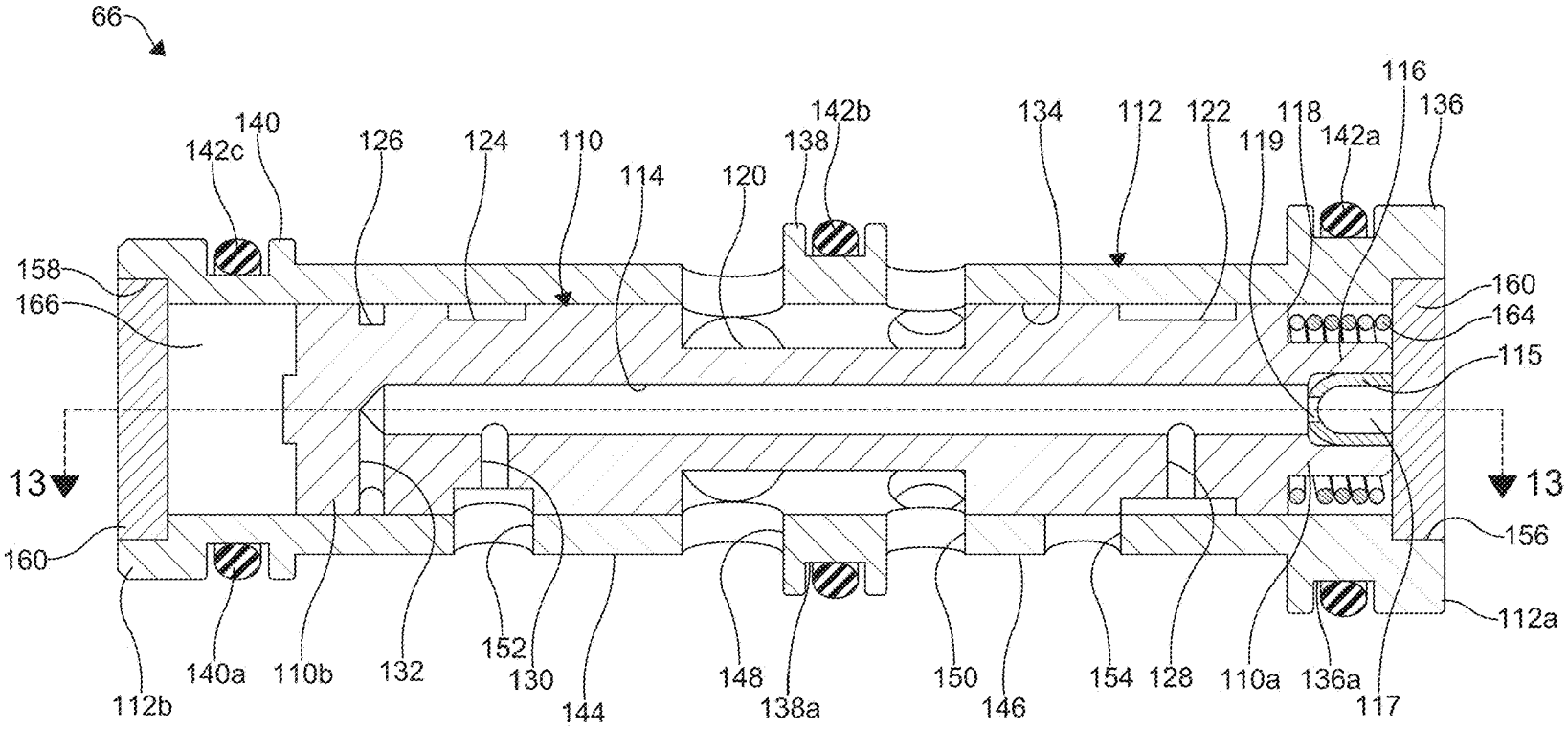
FIG. 12 is an alternate cross sectional view of the of the improved spool assembly shown in FIG. 11 showing the improved spool assembly in a fully actuated position.
Figure 13:
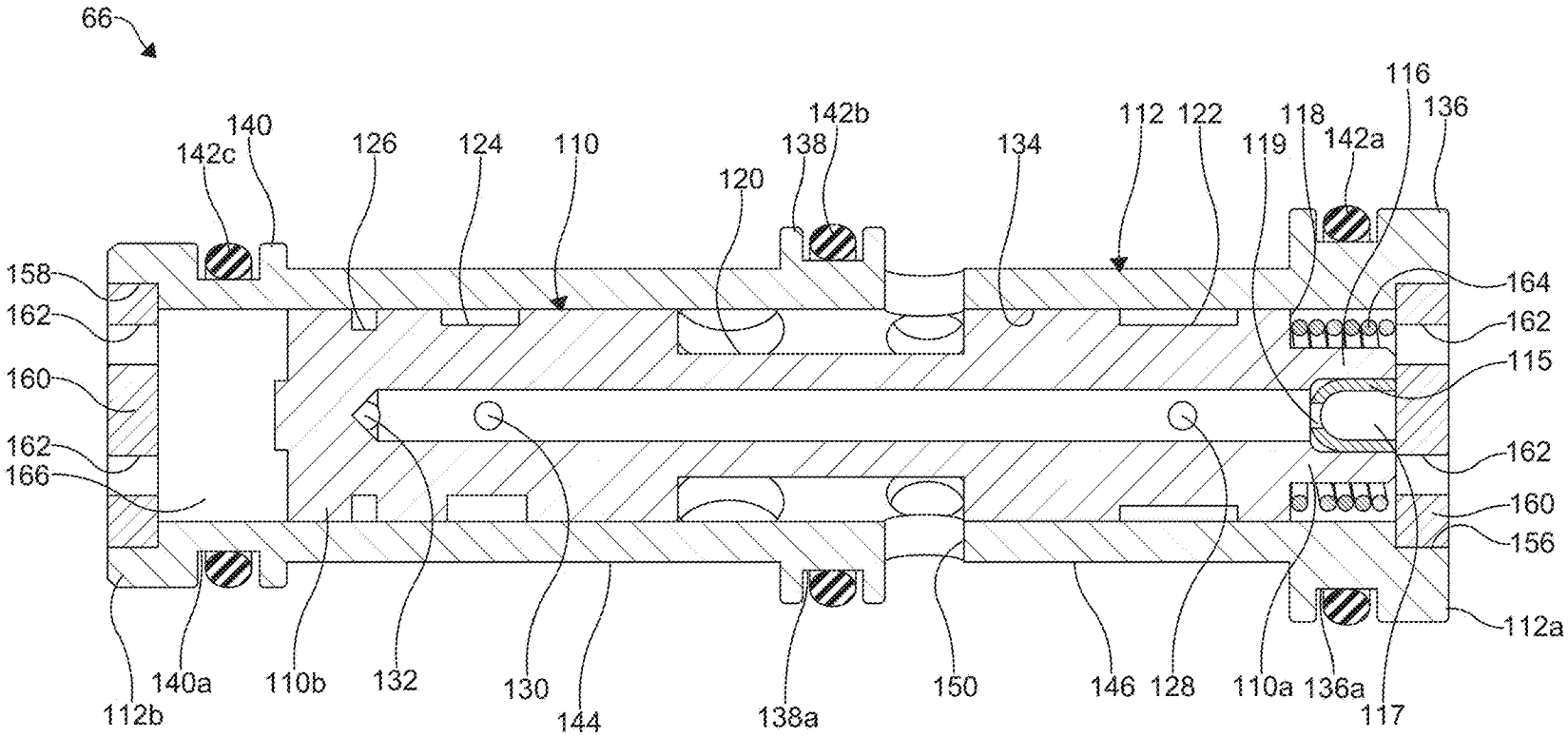
FIG. 13 is a cross sectional view of the improved spool assembly taken along the line 13-13 of FIG. 12.

Thus, when actuated, the microvalve 76 causes the spool 110 to move from the closed position to a fully actuated or fully open position as shown in FIGS. 12 and 13, and a plurality of partially open positions (not shown) between the closed and fully open positions. In the fully open position, the main fluid flow inlet passageway 148 and the main fluid flow outlet passageway 150 are open, thus permitting a main flow of fluid through the spool assembly 66, i.e., through the main fluid flow inlet passageway 148, the first circumferentially extending groove 120 of the spool 110, and the main fluid flow outlet passageway 150. In the fully open position, the feedback flow outlet passageway 154 is closed by the spool 110, but the feedback flow inlet passageway 152 is open and in fluid communication with the inlet fluid flow groove 144, the first circumferentially extending fluid flow groove 85 (see FIG. 8), and the fluid inlet port 88 (see FIG. 8).

The circumferentially extending pressure groove 126 and the fluid passageway 132 are in fluid communication with the bore 114 and are configured to isolate the command chamber 166 from fluid that may leak around the spool 110 (i.e., from the right of the pressure groove 126 when viewing FIGS. 10 through 13), and that may overwhelm the fluid pressure introduced by the microvalve 76. Any fluid that may leak into the command chamber 166 is thus tied to the feedback pressure within the bore 114 and the feedback pressure chamber 117.

During manufacture and assembly of the MSEV 50, the spool assembly bore 62 may be machined in the valve body 52 prior to the capillary tubes 40 and the inlet and outlet connector conduits 36 and 38 being brazed to the valve body 52.

The spool 110, the sleeve 112, and the caps 160 may be formed and assembled to define the spool assembly 66 independently of the valve body 52. The piston bore 134 may thus be machined having a diameter tolerance of about +/−5 μm, without being negatively affected by heat from the brazing operation on the valve body 52. Once assembled, the spool assembly 66 may then be mounted within the spool assembly bore 62.

The spool assembly bore 62 in the valve body 52 is configured to receive, and have fixedly mounted therein, the spool sleeve 112 rather than the slidable spool 110, as in the conventional MSEV 14. Because the spool assembly 66 may be sealed within the spool assembly bore 62 by the metal to metal interference seal S1, and by the O-rings 142*a*, 142*b*, and 142*c*, the diameter tolerance for the spool assembly bore 62 may relatively larger than the tolerance for the spool bore 26 in the conventional valve body 20, such as about +/−50 μm.

Thus, the spool assembly bore 62 may be machined prior to brazing, and therefore the capillary tubes 40 and the inlet and outlet connector conduits 36 and 38 may be thereafter brazed without causing the spool assembly bore 62 to become out of tolerance. The relatively small tolerance of about +/−5 μm between the spool 110 and the sleeve 112 in the spool assembly 66 may also be achieved and maintained in a manufacturing process independent of, and at a location separate from, the machining and brazing steps required to manufacture and assemble the valve body 52.

Because the spool 110 is enclosed within the sleeve 112 by the caps 160, the spool assembly 66 may be easily and safely moved, and may be easily tested independently and separately from the valve body 52 of the MSEV 50, thus saving time and reducing cost.

The principle and mode of operation of this invention have been explained and illustrated in its preferred embodiments. However, it must be understood that this invention may be practiced otherwise than as specifically explained and illustrated without departing from its spirit or scope.

What is claimed is:

1. A two-stage proportional control valve configured for use in a fluid system comprising:

a valve body having a longitudinally extending valve body bore formed therethrough, the valve body bore having a plug bore and a spool assembly bore;

a first stage microvalve mounted within the valve body bore;

a second stage spool assembly mounted within the valve body bore downstream of the microvalve, the second stage spool assembly including:

a sleeve; and a spool slidably mounted within the sleeve, the spool having a spool bore formed therein and extending axially from an open first end to a closed second end, wherein the spool further includes:

a first circumferentially extending groove formed on an outside surface thereof and defining a fluid flow path;

a second circumferentially extending groove formed on an outside surface of the spool near the first end thereof;

a third circumferentially extending groove formed on an outside surface of the spool near the second end thereof;

a circumferentially extending pressure groove formed on an outside surface of the spool between the second axial end and the third circumferentially extending groove;

a first transverse fluid passageway formed through a side wall of the spool between the spool bore and the second circumferentially extending groove;

a second transverse fluid passageway formed through a side wall of the spool between the spool bore and the third circumferentially extending groove; and a third transverse fluid passageway formed through a side wall of the spool between the spool bore and the circumferentially extending pressure groove; and a closure member attached within the spool assembly bore and configured to retain the spool valve assembly within the spool assembly bore, wherein the closure member is configured to be mounted in a leak-tight manner in the spool assembly bore by a metal to metal interference seal defined between the closure member and a shoulder formed in the spool assembly bore.

2. The two-stage proportional control valve according to claim 1, wherein the second stage spool assembly is configured to be assembled and tested independently from the valve body.

3. The two-stage proportional control valve according to claim 1, wherein the first stage microvalve is mounted to a microvalve assembly that includes a microvalve mounting body configured as a plug with which one end of the valve body bore may be closed, and wherein the microvalve mounting body is further configured to be mounted in a leak-tight manner in the valve body bore by a metal to metal interference seal defined between the microvalve mounting body and the valve body.

4. The two-stage proportional control valve according to claim 3, wherein the microvalve mounting body further includes at least one circumferentially extending seal between an outside surface of the microvalve mounting body and the valve body bore.

5. The two-stage proportional control valve according to claim 1, wherein the spool further includes a cup-shaped insert attached within the spool bore at the open first end of the spool, an interior of the insert defining a feedback pressure chamber, the insert having an opening in an end wall thereof that defines a flow path for fluid between the feedback pressure chamber and the spool bore.

6. The two-stage proportional control valve according to claim 1, wherein the sleeve is substantially cylindrical and includes:

an axially extending sleeve bore formed therein and extending from an open first end to an open second end of the sleeve;

a plurality of circumferentially extending sealing portions formed on an outside surface thereof, each sealing portion defining a first circumferentially extending sealing groove; and an annular seal disposed within each circumferentially extending sealing groove, the annular seals providing a fluid-tight seal between the sleeve and the valve body bore.

7. The two-stage proportional control valve according to claim 6, wherein the sleeve further includes a circumferentially extending inlet fluid flow groove and a circumferentially extending outlet fluid flow groove defined in the outside surface of the sleeve, at least one main fluid flow inlet passageway formed through a side wall of the sleeve between the sleeve bore and the inlet fluid flow groove, and at least one main fluid flow outlet passageway formed through the side wall of the sleeve between the sleeve bore and the outlet fluid flow groove.

8. The two-stage proportional control valve according to claim 7, wherein at least one feedback flow inlet passageway is formed through the side wall of the sleeve between the sleeve bore and the inlet fluid flow groove, and at least one feedback flow outlet passageway is formed through the side wall of the sleeve between the sleeve bore and the outlet fluid flow groove.

9. The two-stage proportional control valve according to claim 8, wherein the spool assembly further includes a first cap cavity formed in the first end of the sleeve and a second cap cavity formed in the second end of the sleeve, and wherein a closure member is mounted within each of the first and second cap cavities, the closure member including a fluid passageway formed therethrough.

10. The two-stage proportional control valve according to claim 9, wherein the spool assembly is configured for movement between a closed position, a fully open position, and a plurality of partially open positions, wherein in the closed position the main fluid flow outlet passageway and the feedback flow inlet passageway are closed by the spool, thus preventing fluid flow through the spool assembly, but the feedback flow outlet passageway is open and in fluid communication with the fluid outlet port, wherein in the fully open position the main fluid flow inlet passageway and the main fluid flow outlet passageway are open, thus permitting a main flow of fluid through the spool assembly to the main fluid flow outlet passageway, and wherein in the fully open position, the feedback flow outlet passageway is closed by the spool, but the feedback flow inlet passageway is open and in fluid communication with the fluid inlet port.

11. A method of assembling a two-stage proportional control valve configured for use in a fluid system, the method comprising:

slidably mounting a spool within a sleeve to define a spool valve assembly, the spool having a spool bore formed therein and extending axially from an open first end to a closed second end, wherein the spool further includes:

a first circumferentially extending groove formed on an outside surface thereof and defining a fluid flow path;

a second circumferentially extending groove formed on an outside surface of the spool near the first end thereof;

a third circumferentially extending groove formed on an outside surface of the spool near the second end thereof;

a circumferentially extending pressure groove formed on an outside surface of the spool between the second axial end and the third circumferentially extending groove;

a first transverse fluid passageway formed through a side wall of the spool between the spool bore and the second circumferentially extending groove;

a second transverse fluid passageway formed through a side wall of the spool between the spool bore and the third circumferentially extending groove; and a third transverse fluid passageway formed through a side wall of the spool between the spool bore and the circumferentially extending pressure groove;

mounting the spool valve assembly in a longitudinally extending valve body bore formed through a valve body of a two-stage proportional control valve;

mounting a first stage microvalve to a microvalve mounting body configured as a plug and mounting the microvalve mounting body within the valve body bore;

wherein the spool valve assembly defines a second stage spool assembly of the two-stage proportional control valve and is mounted within the valve body bore downstream of the microvalve;

mounting the microvalve mounting body in a first end of the valve body bore, wherein the microvalve mounting body is mounted within the valve body bore in a leak-tight manner by a metal to metal interference seal defined between the microvalve mounting body and the valve body; and mounting a closure member within a second end of the valve body bore, wherein the closure member is configured to retain the spool valve assembly within the valve body bore, and wherein the closure member is mounted within the valve body bore in a leak-tight manner by a metal to metal interference seal defined between the closure member and a shoulder formed in the valve body bore;

wherein the sleeve is substantially cylindrical, includes an axially extending sleeve bore formed therein and extending from an open first end to an open second end of the sleeve, and includes a circumferentially extending sealing portion formed on an outside surface thereof, the sealing portion defining a circumferentially extending sealing groove;

wherein an annular seal is disposed within the circumferentially extending sealing groove; and wherein the annular seal provides a fluid-tight seal between the sleeve and the valve body bore.

* * * * *